US005553954A

United States Patent [19]

Nakano

[11] Patent Number: 5,553,954

[45] Date of Patent: Sep. 10, 1996

[54] PRINTER

[75] Inventor: Mitsuru Nakano, Tokyo, Japan

[73] Assignee: Citizen Watch Co., Ltd., Tokyo, Japan

[21] Appl. No.: 338,131

[22] Filed: Nov. 9, 1994

[30] Foreign Application Priority Data

Nov. 10, 1993 [JP] Japan ..... 5-303251

[51] Int. Cl.[6] ..... B41J 11/26

[52] U.S. Cl. ..... 400/621; 400/619

[58] Field of Search ..... 400/621, 619; 101/226, 227

[56] References Cited

U.S. PATENT DOCUMENTS 4,941,377 7/1990 Ishihara et al. ..... 400/621

FOREIGN PATENT DOCUMENTS

| | | |
|---|---|---|
| 50-26492 | 3/1975 | Japan . |
| 53-29611 | 3/1978 | Japan . |
| 53-29612 | 3/1978 | Japan . |
| 53-83210 | 7/1978 | Japan . |
| 54-55410 | 4/1979 | Japan . |
| 57-2126 | 1/1982 | Japan . |
| 58-18754 | 2/1983 | Japan . |
| 59-22996 | 7/1984 | Japan . |
| 59-31412 | 9/1984 | Japan . |
| 59-184649 | 12/1984 | Japan . |
| 61-58093 | 4/1986 | Japan . |
| 62-5946 | 1/1987 | Japan . |
| 62-43752 | 3/1987 | Japan . |
| 62-43757 | 3/1987 | Japan . |
| 62-200453 | 12/1987 | Japan . |
| 3-42655 | 4/1991 | Japan . |
| 4-45053 | 4/1992 | Japan . |
| 4-71265 | 6/1992 | Japan . |

*Primary Examiner*—Ren Yan

*Attorney, Agent, or Firm*—Lowe, Price, LeBlanc & Becker

[57] ABSTRACT

A printer in which an end surface of a paper cutter having a sharp blade can be utilized as a paper carrying path by shunting the continuous sheet from the blade. The paper cutter is disposed in the carrying path of the continuous sheet. The paper cutter has a blade extending in a direction transverse to a carrying direction of the continuous sheet at its distal end. A conducting protrusion is formed on a part of the blade of the paper cutter along an extending direction of the blade. An outer periphery of the conducting protrusion, which contacts with the continuous sheet, has a cross section of a substantially circular arc.

20 Claims, 6 Drawing Sheets

PRINTER

BACKGROUND OF THE INVENTION

I. Field of the Invention

This invention relates to a printer in which a paper cutter is disposed in a direction transverse to a carrying direction of a continuous sheet in a carrying path thereof.

II. Description of the Related Art

There is known a printer having a paper cutter arranged in a transverse direction to carrying direction of a continuous sheet on a sheet carrying path. The paper cutter cuts a continuous sheet at a crease portion (perforation) thereon by a blade. However, the blade of the paper cutter tends to hook the creases of the continuous sheet when the continuous sheet travels on the cutter because the tip of the blade is sharp, thereby causing jamming of the paper or a malfunction of paper feeding at the time of a line feed.

Particularly, the creases of the continuous sheet more tend to be hooked by the blade of the paper cutter when the sheet is reversely fed by reverse rotation of a platen in a turn-out operation of the continuous sheet or in a back line feed in printing. The term "back line feed" in printing means, for example, to print the frame of table and thereafter to print numerals or the like inside the frame by reversibly carrying the paper, or when printing double sized characters, to full-size print a lower half and thereafter to reversibly feed the paper in order to full-size print a remained upper half.

There is also known a printer in which both the cut sheet and the continuous paper can be used and the paper cutter is arranged in the transverse direction of the paper in the carrying path of the continuous sheet.

FIG. 9 is a vertical sectional view of such conventional printer. On the upper surface of a printer body 1 there is mounted an automatic sheet feeder (ASF) 2 for feeding the cut sheet 27 to the printer body 1. A continuous sheet 37 is inserted from a continuous sheet inlet 13 to the printer body 1, and carried between an upper guide plate 12 and a lower guide plate 11 by rotationally driving a tractor 9. The continuous sheet 37 is then bent along an outer circumference of the platen 8 by rotation of the platen 8, introduced into a gap between a printing head 7 and the outer circumference of the platen 8, and pulled upwardly by rotation of a feeding roller 10. The continuous sheet 37 is printed by the printing head 7 in contact with a circumference of the platen 8. Thereafter, a leading end of the continuous sheet 37 travels from a paper outlet 35 to upper side of the printer body 1, and discharged to front side of the printer body 1. At the time of the back line feed in printing or turn-out operation of the continuous sheet 37, the platen 8, feeding roller 10 and tractor 9 are reversely rotated, thereby the continuous sheet 37 is fed backwardly.

When the continuous sheet 37 moves on the paper cutter 3, a loop wire 38 is provided in order to prevent the crease portion 37*a* of the continuous sheet 37 from being hooked on blades 4*a* and 4*b*. The loop wire 38 is inserted into a top cover 15' and the continuous sheet 37 passes above a bent portion 38*a* of the loop wire 38, thereby the sheet carrying path is moved upwardly. Thus, the continuous sheet 37 is prevented from contacting directly on the blades 4*a* and 4*b* of the paper cutter 3 and the creases 37*a* are prevented from being hooked by the blades 4*a* and 4*b*.

SUMMARY OF THE INVENTION

An object of the invention is to provide a printer in which creases or perforations of a continuous sheet is shunted from sharp blades of the paper cutter provided in a carrying path of the sheet without using any particular accessories so that the continuous sheet smoothly travels on blades of a paper cutter.

A printer according to the present invention comprises, a carrying means for carrying a continuous sheet along a carrying path; a platen; a printing head cooperating with the platen; a cutter disposed in the carrying path of the continuous sheet and having a blade with a distal end extending in a direction transverse to a carrying direction of the continuous sheet; and a conducting protrusion formed on a part of the blade of the cutter along an extending direction of the blade, an outer periphery of the conducting protrusion to contact with the continuous sheet having a cross-section of a substantially circular arc shape wherein the platen and the printing head are disposed to print on the continuous sheet before the continuous sheet reaches the cutter in moving in the carrying direction. When the continuous sheet travels on the paper cutter, the creases of the continuous sheet contacts with the outer periphery of the conducting protrusion and is smoothly introduced without being hooked on the blade of the paper cutter.

The conducting protrusion as described above may preferably be arranged in the vicinity of a center in an extending direction of the blade of the paper cutter. With this arrangement, the continuous sheet is stably and smoothly guided. In addition, the conducting protrusion is preferably formed into a trapezoidal shape whose width is gradually narrowed towards an end portion to contact with the continuous sheet, when viewed from a direction perpendicular to an extending direction of a surface of the paper cutter. With this arrangement, a lateral end of the continuous sheet, which is not in contact with the conducting protrusion, is easily cut by the blade of the paper cutter.

According to the invention, an automatic paper feeding device for feeding cut sheets to the printer body is detachably mounted on the printer or incorporated into the printer.

DETAILED DESCRIPTION OF THE PREFERRED EMBODIMENT

Figure 1:
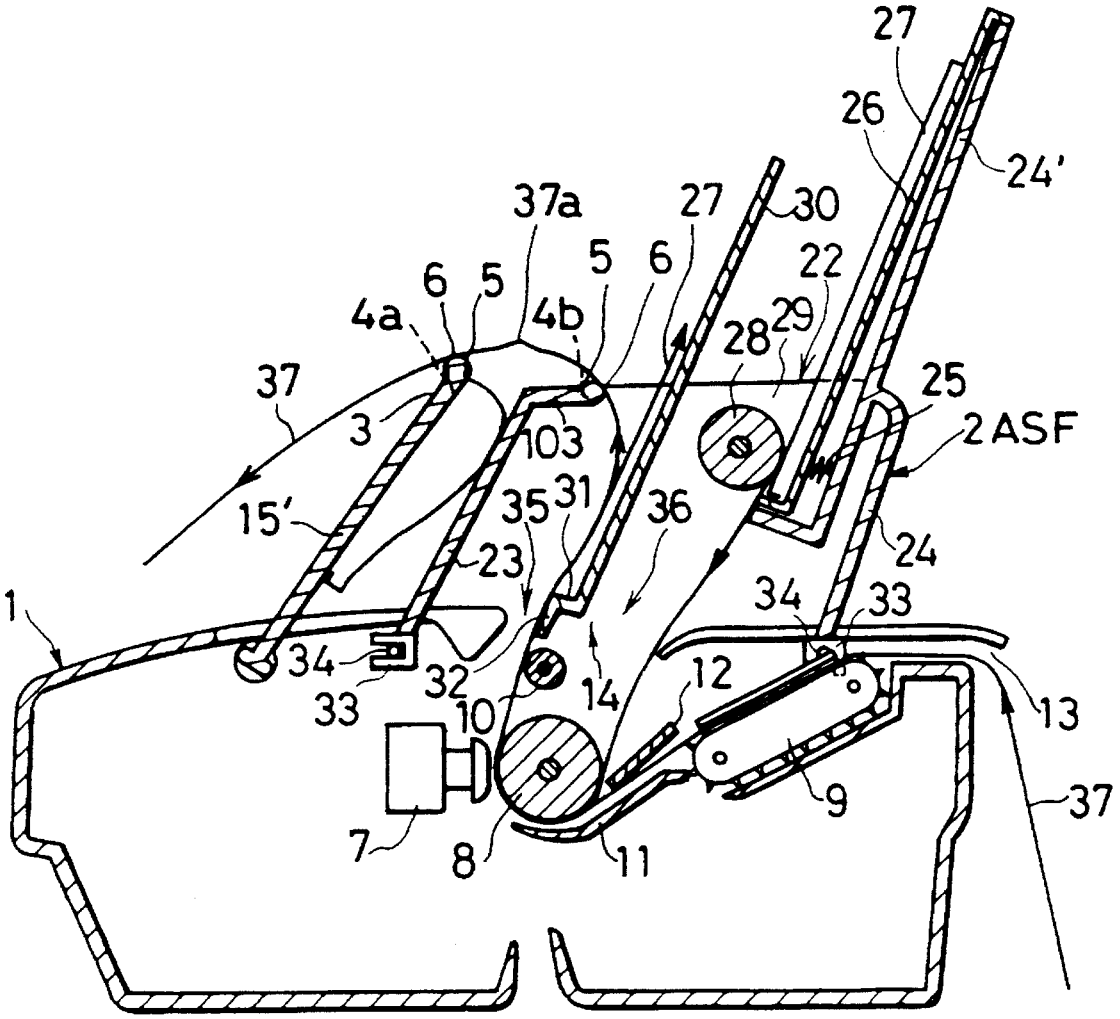
FIG. 1 is a vertical sectional view of a printer according to a first embodiment of the invention.

A printer according to a first embodiment of the present invention, as shown in FIG. 1, comprising a printer body 1, and an automatic paper feeder (ASF) 2 detachably mounted on upper surface of the printer body 1 and for feeding a cut sheet 27 to the printer body 1.

In the printer body 1, a platen 8 is rotatably supported. Above the platen 8 a feeding roller 10 for feeding and discharging a cut sheet and a continuous sheet is rotatably supported. A printing head 7 is disposed in confronting relation to the platen 8 in a front side thereof. Under the platen 8 a lower guide plate 11 is provided along outer circumference of the platen 8. An upper guide plate 12 is disposed inclined towards the platen 8 behind the platen 8 and above the lower guide plate 11. A tractor 9 for carrying a continuous sheet 37 is disposed in a rear portion of the printer body 1. A front end of the tractor 9 faces between a rear end of the upper guide plate 12 and a rear end of the lower guide plate 11. A rear end of the tractor 9 faces a continuous sheet inlet 13 formed on the printer body 1.

The platen 8 is rotatably driven by a paper feeding motor (not shown). The feeding roller 10 is rotated in the same direction as the platen 8 via a rotation transfer mechanism such as a gear train (not shown). The tractor 9 is rotatably driven in the paper feeding direction by the paper feeding motor in a continuous sheet mode.

Above the platen 8 an opening 14 substantially corresponding to a width of the sheet is formed on an upper surface of the printer body 1. On a front side of the opening 14, a top cover 15' is rotatably supported on the printer body 1 to be opened and closed. A paper cutter 3 having a blade **4*a* for cutting the continuous sheet is provided on an upper end of the top cover 15' integrally with the top cover 15'**.

The ASF 2 is facing to the opening 14 of the printer body 1 and mounted on an upper portion of the printing body 1. A body 22 of the ASF 2, which forms an outer configuration of ASF 2, has a front plate 23, a rear plate 24 and a side plate 29. The front plate 23 and the rear plate 24 are arranged inclined with each lower end positioned forwardly of the printer body 1. The back plate 24' is integrally formed on an upper end of the rear plate 24 so that it extends upwardly and substantially in parallel with the rear plate 24. A cut sheet cassette 26 is disposed on a front surface-side of the back plate 24' and a plurality of cut sheets 27 are loaded on the cassette 26 in layers.

A friction roller 28 for feeding the cut sheets is rotatably supported on a side plate 29 in confronting relation to a front surface of the cut sheet cassette 26. A cut sheet receiver 30 is disposed in front of the friction roller 28. The cut sheet receiver 30 has a step 31 formed integrally thereon for receiving the cut sheet 27 discharged from the feeding roller 10 and a separation plate 32 extending towards the feeding roller 10 from a front end of the step 31.

The cut sheet cassette 26 is disposed to be inclined with its lower end positioned closer to the front end of the body 1 than its upper end. The lower portion of the cassette 26 is urged to the friction roller 28 by a spring 25 so that the cut sheet 27 loaded on the cassette 26 is always contact with the friction roller 28.

An upper end of the front plate 23 is bent and extends backwardly, and the paper cutter 3 is provided at the upper end of the front plate 23. A blade **4*b* is formed on a tip end of the paper cutter 3, in a direction transverse to a carrying direction of the continuous sheet 37**.

An engaging piece 33 for attaching ASF is provided on the lower end of the side plate 29 of the ASF body 22. The ASF 2 is attached to the printer body 1 by opening the top cover 15' to expose the opening 14 to rotate around an axis of its base end-side, and engaging the engaging piece 33 for attaching ASF with a projected pin 34 provided on a side frame of the printer body 1.

The separation plate 32 of the cut sheet receiver 30 partitions the opening 14 into front and rear spaces, and the lower end of the separation plate 32 is located above the feeding roller 10. A front space of the opening 14 partitioned by the cut sheet receiver 30 serves as a paper outlet 35 of the continuous sheet 37 and cut sheet 27, and a rear space of the opening 14 serves as an inlet 36 for the cut sheet 27.

Although not shown in the drawing, a switching lever for switching a paper feeding mode is rotatably mounted on the printer body 1 and an operating portion thereof is projected from the printer body 1. The switching lever is operably connected with a transmission gear for transmitting rotation of the paper feeding motor. The transmission gear is selectably engaged with a driving gear of the tractor 9 or a gear fixed on a shaft of the friction roller 28 in ASF 2. When the switching lever is operated to switch on the continuous sheet mode, the transmission gear engages with the driving gear of the tractor 9 and is released from a gear of the friction roller 28 of ASF 2. When the switching lever is operated to switch on the cut sheet mode, the transmission gear is released from a driving gear of the continuous sheet feeding tractor 9 and engages with the gear of the friction roller 28.

The continuous sheet 37 is inserted into the printer body 1 from the continuous sheet inlet 13, and carried through the gap between the upper guide plate 12 and the lower guide plate 11 by rotational drive of the tractor 9. Thereafter, the continuous sheet 37 is bent along the outer circumference of the platen 8 by the rotation of platen 8, guided to a gap between the printing head 7 and the outer circumference of the platen 8, and then pulled upwardly by the rotation of the feeding roller 10. Thus, the continuous sheet 37 is printed by the printing head 7 while closely contacting with the circumference of the platen 8. Thereafter, the leading end of the continuous sheet 37 is carried to an upper side of the printer body 1 from the paper outlet 35 and is discharged to the front side of the printer body 1. At the time of the back line feed in printing or turn-out operation of the continuous sheet 37, the platen 8, feeding roller 10 and tractor 9 are reversely rotated, thereby the continuous sheet 37 is fed backwardly.

The cut sheet 27 is fed downwardly from the cut sheet cassette 26 by the rotation of the friction roller 28. The cut sheet 27 passes through the cut sheet inlet 36 and is introduced into a gap between the upper guide plate 12 and the outer circumference of the platen 8 by rotation of the platen 8. Further, the cut sheet 27 is guided by the lower guide plate 11 and bent along the outer circumference of the platen 8, and introduced into the gap between the printing head 7 and the outer circumference of the platen 8. The cut sheet 27 is then pulled upwardly by the rotation of the feeding roller 10. The cut sheet 27 is printed by the printer head 7 in the same manner as the continuous sheet. Subsequently, the cut sheet 27 travels from the paper outlet 35 to the upper side of the printer body 1 and is discharged on the step 31 of the cut sheet receiver 30.

A conducting protrusion 5 is formed respectively on the blade **4*a* of the paper cutter 3 provided at the top cover 15' and on the blade 4*b* of the paper cutter 103 provided at the front plate 23 of the ASF 2**.

The conducting protrusion 5 in the present embodiment is provided only on a central portion of a blade 4 of the paper cutter 3 along an extending direction of the blade 4.

Figure 2:
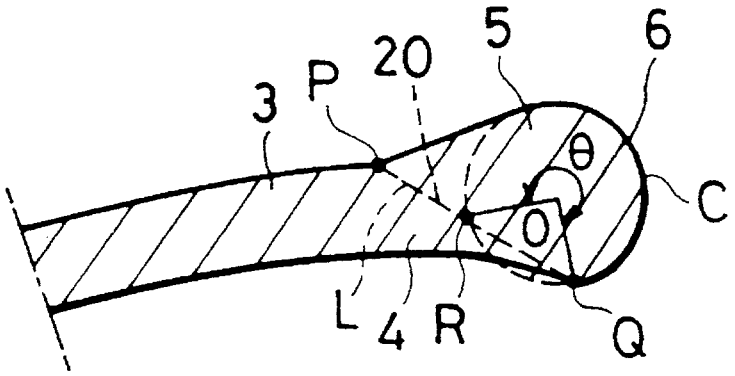
FIG. 2 is an enlarged sectional view of a tip end of a paper cutter.

In a vertical sectional view of the paper cutter 3, as shown in FIG. 2, a blade surface 20 is formed downwardly inclined from an upper end P to a lower end Q of the blade 4, and the blade 4 has a sharp tip end at the lower end Q.

The conducting protrusion 5 is formed over a region from the lower end Q to the upper end P of the blade 4. A cross section of an outer peripheral portion of the protrusion 5, i.e., a contact surface 6 which contacts with the continuous sheet 37 is of a substantially circular arc shape. The lower end Q of the blade 4 is positioned on a circumference of a circular arc C defining the contact surface 6 as shown in FIG. 2, or inside the circular arc C. Thus, the lower end Q does not project from the conducting protrusion 5. A protruding amount of the conducting protrusion 5 from the blade surface 20 is determined by a position of a center O of the circular arc C and its radius. The center O of the circular arc C is positioned so that a center angle θ of a major arc having end points Q and R is equal to or more than 240°. The points Q and R are two intersection points of the circular arc C and a straight line L representing the blade surface 20. A radius of the circular arc C defining a contact surface 6 may preferably be approximately 2 mm. If the radius is too large it is difficult to cut the continuous sheet 37 by the blade 4, and if the radius is too small the continuous sheet 37 tends to be hooked.

Figure 3:
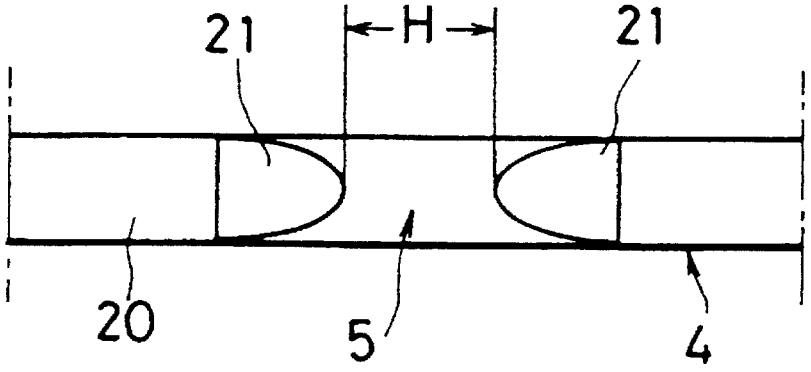
FIG. 3 is an elevational view of the tip end of the paper cutter.
Figure 5:
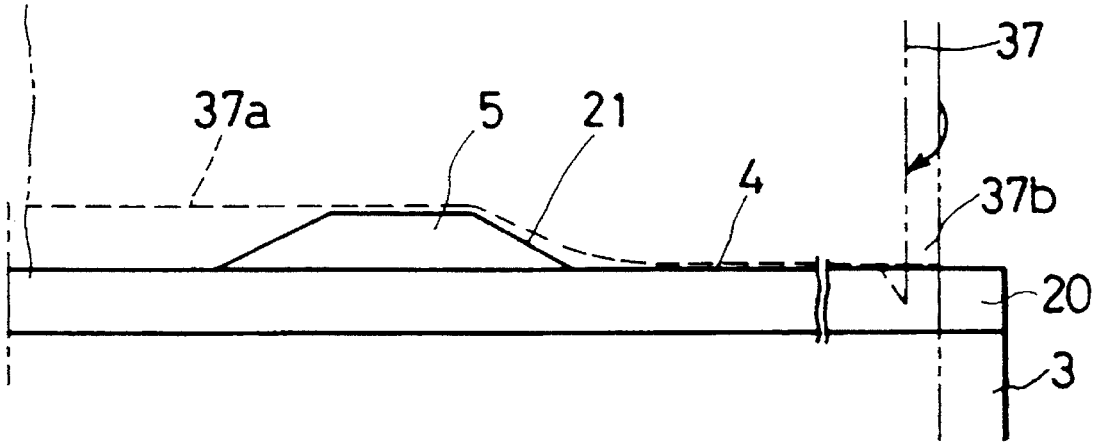
FIG. 5 is a plan view of the paper cutter showing a status of cutting a continuous sheet by blades of the paper cutter.

A lateral slant surface 21 of U-shape is formed at both sides of the conducting protrusion 5 from a top of the contact surface 6 towards the blade surface 20, in an elevational view of the paper cutter 3 as shown in FIG. 3 (a projection view in a surface direction of the paper cutter 3). A contour of the lateral slant surface 21 is similar to a parabolic shape which appears on obliquely cutting a column. Accordingly, the conducting protrusion 5 has a trapezoidal profile whose width gradually comes narrower to its uppermost portion in a plan view of the paper cutter 3 as shown in FIG. 5 (a projection view in a direction orthogonal to a surface of the paper cutter 3). A top portion of the contact surface 6 extends substantially in parallel with the blade surface 20.

With a trapezoidal profile of the conducting protrusion 5 as described, the continuous sheet 37 is easily curved along the lateral slant surface 21 of the conducting protrusion 5 and easily cut by the blade 4 from a lateral end **37*b* of creases 37*a*, which is not in contact with the conducting protrusion 5, when cutting the continuous sheet 37 as shown in FIG. 5**.

As shown in FIG. 3, a length H of the top of the contact surface 6 of the conducting protrusion 5 is limited within a predetermined range in the blade 4. If the length H is too small the creases of the continuous sheet 37 tend to be hooked on the blade 4 in back feed of the continuous sheet 37, and if the length H is too large it would be difficult to cut the continuous sheet 37 by the blade 4. The length H of the contact surface 6 may preferably be approximately 2 cm.

As shown in FIG. 1, the continuous sheet 37 is discharged to the upper side of the printer body 1 from the paper outlet 35, and contacts with the contact surface 6 of the conducting protrusion 5 respectively provided on tip ends of the paper cutter 3 of ASF 2 and the top cover 15', so that the continuous sheet 37 is discharged to the front side of the printer body 1.

At that time, the top end of the conducting protrusion 5 prevents the blade 4 from being engaged with or hooked to the creases **37*a* of the continuous sheet 37 since the conducting protrusion 5 has an outer periphery of circular arc shape, thereby the continuous sheet 37** is smoothly discharged.

Figure 4:
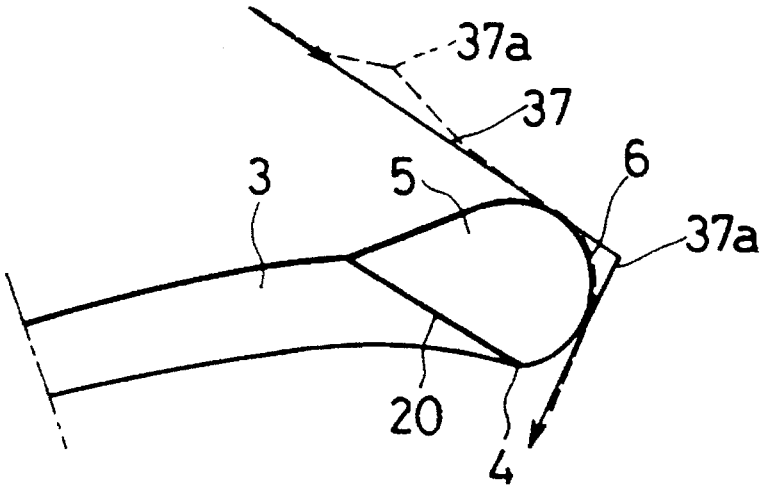
FIG. 4 is a side view showing an introducing status of a continuous sheet by a contact surface of an conducting protrusion.

In the turn-out operation of the continuous sheet 37 to switch the printing mode from the continuous sheet to the cut sheet, or in the back line feed during printing, the continuous sheet 37 is reversely fed. At this time, as the contact surface 6 of the conducting protrusion 5 contacts with the creases **37*a* of the continuous sheet 37, the creases 37*a* is not hooked to the blade 4 of the paper cutter 3, as shown in FIG. 4, so that the continuous sheet 37** is smoothly conducted.

Figure 9:
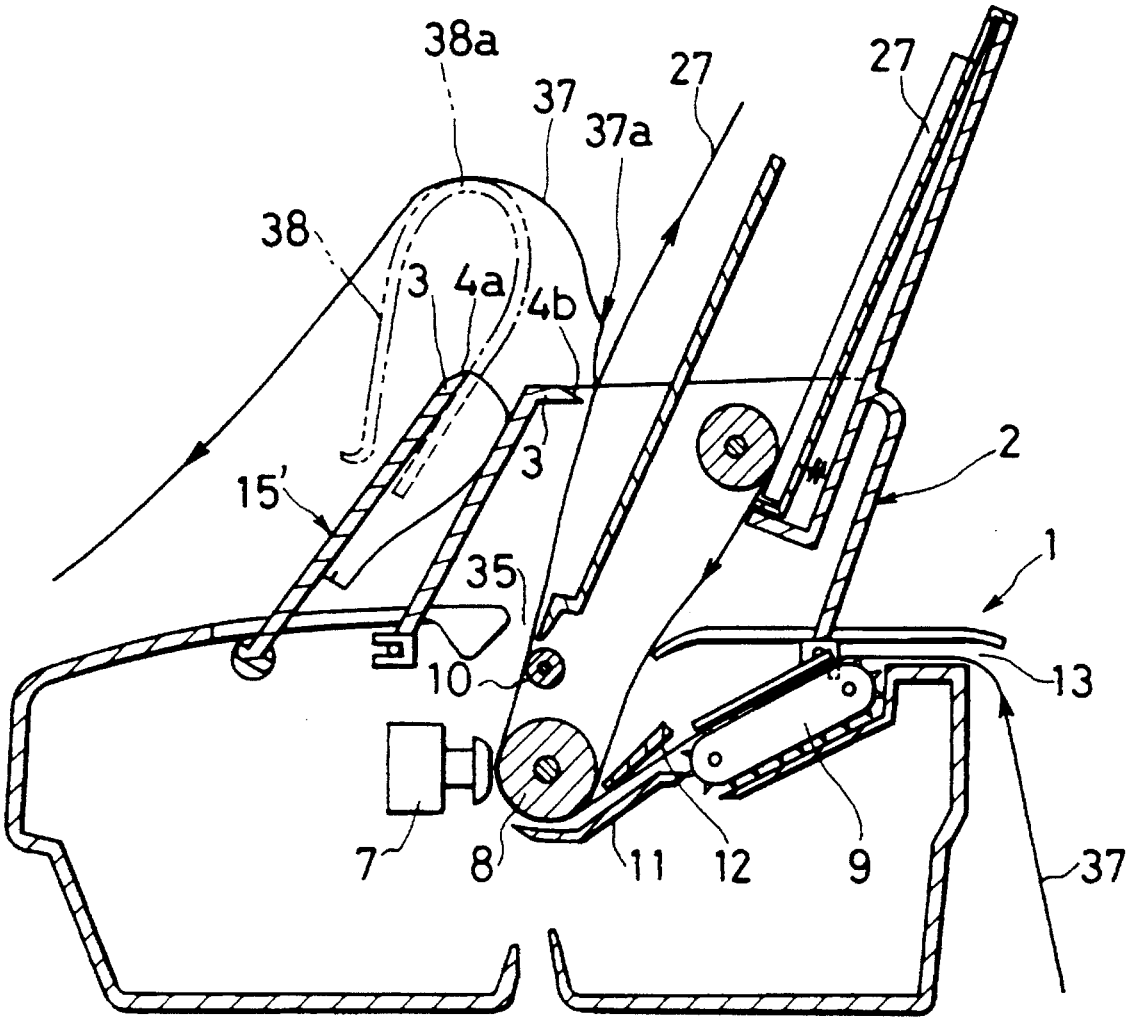
FIG. 9 (PRIOR ART)
FIG. 9 is a vertical sectional view of the conventional printer.

In a printer according to the first embodiment, the creases **37*a* of the continuous sheet 37 is shunted from the sharp blade 4 of the paper cutter 3 provided in the paper carrying path without using an additional attachment such as a loop wire 38 shown in FIG. 9, hence, the end surface of the paper cutter 3 having the sharp blade 4** can be utilized as a paper carrying path.

Figure 6:
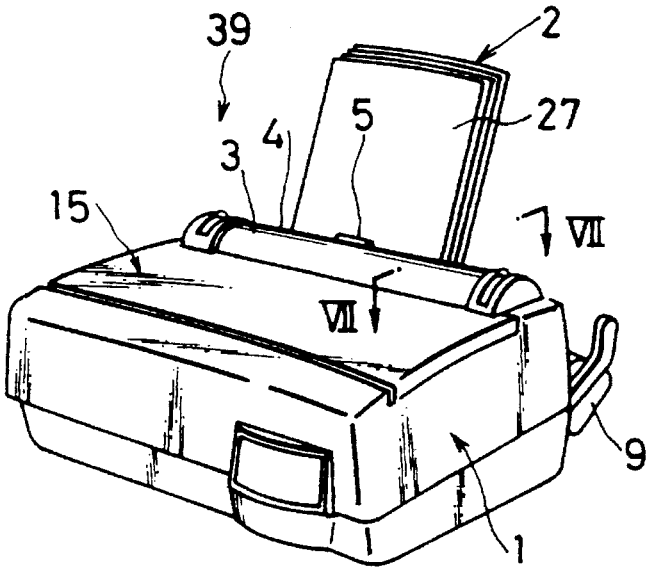
FIG. 6 is a perspective view of a printer according to a second embodiment of the invention.
Figure 7:
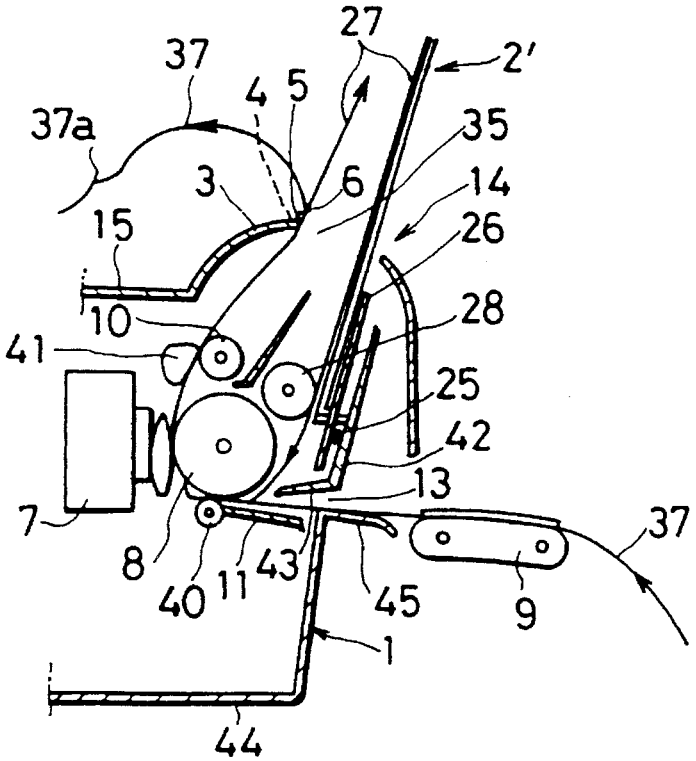
FIG. 7 is an enlarged sectional view of the printer shown in FIG. 6, taken along line VII—VII.

FIG. 6 is a perspective view of a printer 39 according to a second embodiment of the invention, and FIG. 7 is a vertical sectional view of the printer 39. An automatic paper feeder (ASF) 2' for cut sheets is incorporated in back portion of a printer body 1 of the printer 39.

As shown in FIG. 7, the platen 8, the feeding roller 10 and a friction roller 40 in contact with the platen 8 are rotatably supported in the printer body 1. Under the platen 8, a lower guide plate 11 is provided along the outer circumference of the platen 8. The printing head 7 is disposed in confronting relation to a front surface of the platen 8. A paper guide member 41 is provided in front of the feeding roller 10.

The automatic paper feeder 2' is arranged integrally with the printer body 1 behind the platen 8. The automatic paper feeder 2' includes a cut sheet cassette 26 which is forwardly urged by a spring 25 in front of a back plate 42 formed integrally with the printer body 1. A plurality of cut sheets 27 are loaded on the cut sheet cassette 26 in layers. The friction roller 28 for feeding the cut sheet is rotatably supported on the printer body 1, opposing to a front surface of the cut sheet cassette 26. A project portion 43 bent toward the lower guide plate 11 is integrally formed at lower end of the back plate 42 of the automatic paper feeder 2'.

The tractor 9 for carrying the continuous sheet is disposed behind the printer body 1 rearward of the automatic paper feeding mechanism 2'. In front of the tractor 9, a bottom plate 44 of the printer body 1 is formed to be bent upward towards a lower end of the back plate 42 of the automatic paper feeder 2', and at an upper end of the bottom plate 44 a projection 45 is integrally formed to extend towards the tractor 9. The continuous sheet inlet 13 is formed between the projection 45 and the projection 43 formed at the lower end of the back plate 42 of the automatic paper feeder 2'.

The top cover 15 is provided at an upper portion of the printer body 1 to be capable of being opened and closed. The base end of the top cover 15 is rotatably supported on an upper front portion of the printer body 1 and the paper cutter 3 is integrally formed in a front portion of the top cover 15 in an upwardly oblique direction. A tip end of the paper cutter 3 is positioned above the friction roller 28 of the automatic paper feeder 2'. The tip end of the paper cutter 3 and the upper rear edge of the printer body 1 cooperatively define an opening 14 corresponding to the width of the sheet. An upper end of the cut sheet 27 placed on the cut sheet cassette 26 of the automatic paper feeder 2' is projected from the opening 14, and the opening 14 serves as a paper outlet 35 for the continuous sheet 37 and also for the cut sheet 27. The paper cutter 3 is arranged in the carrying path of the continuous sheet 37 in a direction traversing the sheet. The conducting protrusion 5 as shown in FIGS. 2 and 3 is formed at a central portion in an extending direction of the blade 4 of the paper cutter 3.

Figure 8:
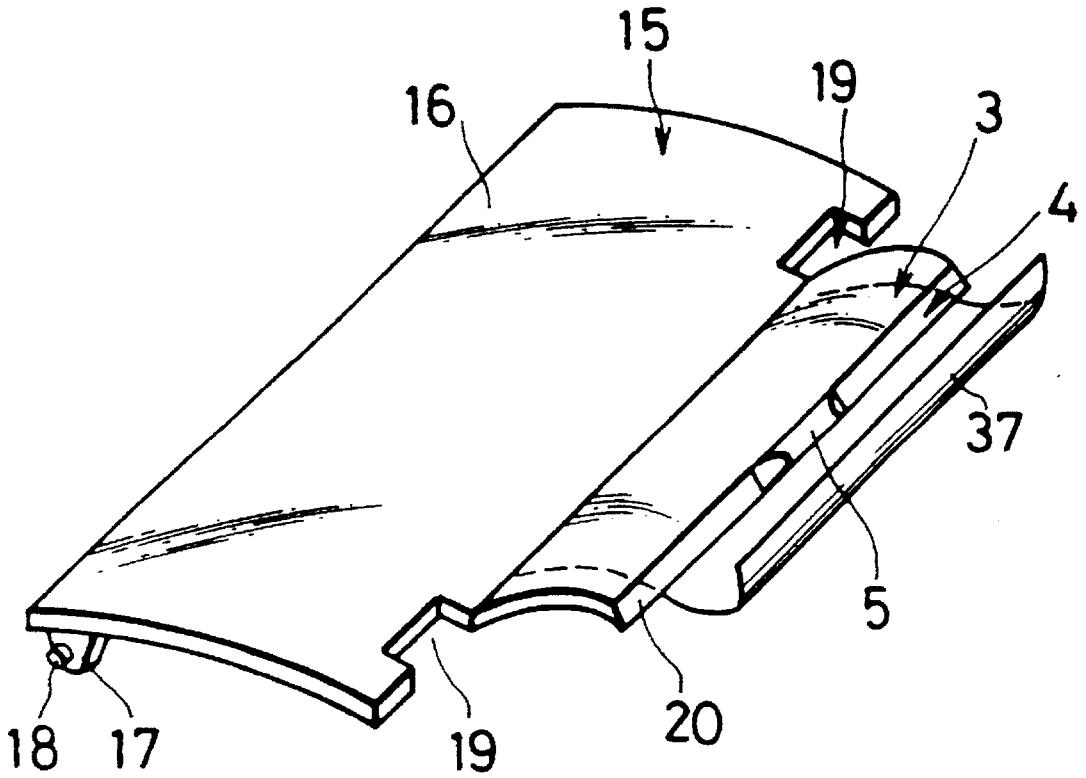
FIG. 8 is a perspective view of a top cover of the printer shown in FIG. 6.

The top cover 15 comprises a plate member 16 with an upper surface formed to be slightly curved, so that a central portion protrudes with respect to front and rear ends, as shown in FIG. 8. The paper cutter 3 is integrally formed at a rear end of the plate member 16.

On the top cover 15, a projecting piece 17 is integrally formed on both sides of front lower surface of the plate member 16, and a pin 18 for attaching the top cover 15 to the printer body 1 is integrally formed on the projecting piece 17, to project in a transverse direction of the top cover 15. A rear end of the plate member 16 is joined with the paper cutter 3 at an intermediate portion in the transverse direction, and recesses 19, which are cut out to rectangular shapes, are provided at a rear end of the plate member 16 in the vicinity of both side edges.

When mounting the top cover 15 on the printer body 1, the pin 18 provided on the projecting pieces 17 of the top cover 15 is inserted into an engaging hole (not shown) provided on a upper front portion of the printer body 1.

The platen 8, tractor 9 and feeding roller 10 are rotated forwardly or reversely in the same direction with each other by the paper feeding motor (not shown). As is the case of the first embodiment, a shift between the cut sheet mode and the continuous sheet mode is made by a switch lever (not shown).

As shown in FIG. 7, when the continuous sheet 37 is inserted into the continuous sheet inlet 13 by rotationally driving the tractor 9, the continuous sheet 37 is guided by the lower guide plate 11 and introduced to an abutment of the friction roller 40 and the platen 8 by the rotating platen 8. Subsequently, the continuous sheet 37 is curvedly introduced along outer circumference of the platen 8, guided into a gap between the printing head 7 and the outer circumference of the platen 8, and introduced upwardly by the rotating platen 8. The continuous sheet 37, which is introduced into an abutment of the feeding roller 10 and the paper guide member 41, is pulled upwardly by rotation of the feeding roller 10. The continuous sheet 37 is printed by the printing head 7 while being in contact with a surface of the platen 8. Thereafter, the leading end of the continuous sheet 37 is carried upwardly by the rotation of the platen 8 and the feeding roller 10, and reaches the top cover 15 after being discharged from the paper outlet 35. The continuous sheet 37 then contacts with the contact surface 6 of the conducting protrusion 5 on the tip end of the paper cutter 3 and is discharged to a front side of the printer body 1.

At that time, as is the case of the first embodiment, the contact surface 6 prevents the blade 4 from entering into the creases 37*a* of the continuous sheet 37 and therefore eliminates hooking of the creases 37*a* by the blade 4, to achieve a smooth discharge of the continuous sheet 37.

On the other hand, the cut sheet 27 is fed downwardly from the cut sheet cassette 26 by rotation of the friction roller 28. The cut sheet 27 abuts on the lower guide plate 11 and curvedly guided by the lower guide plate 11. The cut sheet 27 is then introduced to an abutment of the friction roller 40 and the platen 8. Thereafter, the cut sheet 27 is curvedly guided along outer circumference of the platen 8, introduced into a gap between the printing head 7 and the outer circumference of the platen 8, and carried upwardly by rotation of the platen 8. The cut sheet 27 is further guided by the paper guide member 41 to be introduced into an abutment of the feeding roller 10 and the paper guide receiver 41, and pulled upwardly by rotation of the feeding roller 10. The cut sheet 27 is, while being in contact with the platen 8, printed by the printing head 7. Thereafter, the cut sheet 27 is carried upwardly by rotation of the platen 8 and the feeding roller 10, thus discharged to the upper surface of the top cover 15 from the paper outlet 35.

In the turn-out operation of the continuous sheet 37 to switch the printing mode from the continuous sheet to the cut sheet, or in the back line feed during printing, the continuous sheet 37 is reversely fed. In this second embodiment, in the same manner as shown in FIG. 4, the contact surface 6 of the conducting protrusion 5 contacts with the creases 37*a* of the continuous sheet 37 and the creases 37*a* is not hooked to the blade 4 of the paper cutter 3, so that the continuous sheet 37 is smoothly conducted.

As the conducting protrusion 5 is provided in a central region of the blade 4 of the paper cutter 3, a central portion of the continuous sheet 37 is supported by the conducting protrusion 5 and the lateral ends of the continuous sheet 37 are lifted up. Thus, the continuous sheet 37 is smoothly carried while the creases 37*a* keeps its extending direction constant.

The present invention is not limited to the concrete structure as shown in the drawings. For example, the contact surface 6 of the conducting protrusion 5, which contacts with the continuous sheet 37, may be formed in the other shape, provided that such shape permits a smooth movement of the continuous sheet. Such shape includes a higher order polygon, for example.

According to the present invention, the contact surface of the conducting protrusion provided on the paper cutter contacts with the creases of the continuous sheet, so that the continuous sheet is smoothly conducted without being hooked on the blade of the paper cutter. As a consequence, paper jamming or malfunction of the paper feed in line feeding is prevented since the continuous sheet is smoothly reversely fed in the case of the back line feed during printing and the turn-out operation of the continuous sheet when switching from the continuous sheet to the cut sheet in the printer having the ASF for supplying the cut sheets. In addition, it is unnecessary to use any particular accessories for shunting the creases of the continuous sheet from the sharp blade of the paper cutter in the paper carrying path. Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. A printer, comprising;

a carrying means for carrying a continuous sheet along a carrying path;

a platen;

a printing head cooperating with the platen;

a first cutter having a first surface facing the continuous sheet and disposed in said carrying path of the continuous sheet and having a first blade surface intersecting the first surface to define a blade edge extending in a direction transverse to a carrying direction of the continuous sheet; and a first conducting protrusion formed on said first blade surface of said first cutter along said extending direction of said first blade edge, an outer periphery of said first conducting protrusion being disposed to make contact with the continuous sheet and having a cross-section of a substantially circular arc shape, wherein said platen and printing head are disposed to print on said continuous sheet before the continuous sheet reaches said first cutter when the continuous sheet is moved in said carrying direction.

2. The printer according to claim 1, further comprising:

an automatic cut sheet feeding device detachably mounted to said printer for feeding cut sheets.

3. The printer according to claim 2, wherein:

said first conducting protrusion is formed in the vicinity of a center of said first blade surface in said extending direction of said first blade edge.

4. The printer according to claim 2, wherein:

said first conducting protrusion has a trapezoidal profile, when viewed from a direction perpendicular to said extending direction of said first blade edge, with a width which is gradually narrowed towards an end portion making contact with the continuous sheet when viewed from a direction perpendicular to said first blade surface.

5. The printer according to claim 2, wherein:

said automatic cut sheet feeding device is provided with a second cutter having a second surface facing the continuous sheet and having a second blade surface intersecting the second surface to define a second blade edge extending in a direction transverse to said carrying direction of the continuous sheet.

6. The printer according to claim 5, wherein:

said second blades surface is provided with a second conducting protrusion along said extending direction of said second blade edge, an outer periphery of said second conducting protrusion being disposed to make contact the continuous sheet and having a cross-section of a substantially circular arc shape.

7. The printer according to claim 6, wherein:

said second conducting protrusion is formed in the vicinity of a center of said second blade surface in said extending direction of said second blade edge.

8. The printer according to claim 6, wherein:

said second conducting protrusion has a trapezoidal profile, when viewed from a direction perpendicular to said extending direction of said second blade edge, with a width which is gradually narrowed towards an end portion making contact with the continuous sheet when viewed from a direction perpendicular to said second blade surface.

9. The printer according to claim 5, wherein:

said second blade edge is disposed between said first blade edge and said platen.

10. The printer according to claim 5, wherein:

said substantially circular arc shape comprises a portion formed to an arc of radius approximately 2 mm.

11. The printer according to claim 10, wherein:

said first conducting protrusion has a sheet-contacting surface of a length approximately 2 cm.

12. The printer according to claim 5, wherein:

said first conducting protrusion has a sheet-contacting surface of a length approximately 2 cm.

13. The printer according to claim 1, further comprising:

an automatic cut sheet feeding device incorporated into said printer for feeding cut sheets.

14. The printer according to claim 13, wherein:

said first conducting protrusion is formed in the vicinity of a center of said first blade surface in said extending direction of said first blade edge.

15. The printer according to claim 13, wherein:

said first conducting protrusion has a trapezoidal profile, when viewed from a direction perpendicular to said extending direction of said first blade edge, with a width which is gradually narrowed towards an end portion making contact with the continuous sheet when viewed from a direction perpendicular to said first blade surface.

16. The printer according to claim 1, wherein:

said first conducting protrusion is formed in the vicinity of a center of said first blade surface in said extending direction of said first blade edge.

17. The printer according to claim 1, wherein:

said first conducting protrusion has a trapezoidal profile, when viewed from a direction perpendicular to said extending direction of said first blade edge, with a width which is gradually narrowed towards an end portion making contact with the continuous sheet when viewed from a direction perpendicular to said first blade surface.

18. The printer according to claim 1, wherein:

said substantially circular arc shape comprises a portion formed to an arc of radius approximately 2 mm.

19. The printer according to claim 18, wherein:

said first conducting protrusion has a sheet-contacting surface of a length approximately 2 cm.

20. The printer according to claim 1, wherein:

said first conducting protrusion has a sheet-contacting surface of a length approximately 2 cm.

* * * * *